United States Patent [19]

Smith, Jr. et al.

[11] 4,358,511

[45] Nov. 9, 1982

[54] TUBE MATERIAL FOR SOUR WELLS OF INTERMEDIATE DEPTHS

[75] Inventors: Darrell F. Smith, Jr.; Edward F. Clatworthy, both of Huntington, W. Va.

[73] Assignee: Huntington Alloys, Inc., Huntington, W. Va.

[21] Appl. No.: 202,742

[22] Filed: Oct. 31, 1980

[51] Int. Cl.[3] ..... B21C 37/06

[52] U.S. Cl. ..... 428/595; 138/177; 148/31; 420/448

[58] Field of Search ..... 75/122, 134 F, 134 C; 148/31, 32; 138/177; 428/595

[56] References Cited

U.S. PATENT DOCUMENTS

| | | | |
|---|---|---|---|
| 2,777,766 | 1/1977 | Binder | 75/134 |
| 4,063,934 | 12/1977 | Thuilliev et al. | 75/122 |
| 4,195,987 | 4/1980 | Herchenroeder | 75/134 F |
| 4,248,629 | 2/1981 | Pons et al. | 75/134 F |
| 4,255,186 | 3/1981 | Rouby et al. | 75/122 |

FOREIGN PATENT DOCUMENTS

| | | | |
|---|---|---|---|
| 172869 | 8/1965 | U.S.S.R. | 75/122 |
| 390183 | 11/1973 | U.S.S.R. | 75/128 E |

OTHER PUBLICATIONS

Brochure entitled "Hastelloy Alloy G", (12 pp.) Stellite Div., Cabot Corp.

Brochure entitled "Incoloy Alloy 825", (10 pp.) Huntington Alloys Inc.

*Primary Examiner*—Michael L. Lewis

*Attorney, Agent, or Firm*—Ewan C. MacQueen; Raymond J. Kenny

[57] ABSTRACT

Directed to a nickel-chromium-molybdenum alloy containing about 1.3% to about 3% of aluminum plus titanium, which is particularly useful where corrosion resistance, strength and ductility are required, such as in oil well tubing.

5 Claims, No Drawings

TUBE MATERIAL FOR SOUR WELLS OF INTERMEDIATE DEPTHS

BACKGROUND OF THE INVENTION AND PRIOR ART

As the search for gaseous and liquid hydrocarbons has proceeded in North America under the impetus of the prospective cutoff of Middle Eastern supplies, a host of new problems have been encountered. Thus, exploration for oil and gas has proceeded to ever greater depths and it has been found that ever more severe problems by way of corrosion of metallic tubular materials in the wells are encountered. As the wells are driven more deeply into the earth, in particular with respect to offshore locations, greater pressures and temperatures are encountered and, in addition, combinations of corrosive ingredients are encountered to an extent not found before. Thus, in certain wells which are driven to depths of possibly 15,000 feet substantial quantities of hydrogen sulfide together with water, salt and carbon dioxide are found along with methane and other hydrocarbons. In some instances, the dilution of the valuable hydrocarbon with corrosive and undesirable ingredients has been so severe that the valuable hydrocarbon is in fact a minor constituent of the gas mixture recovered. The unexpected severity of the problems encountered has lead to failures of drill strings and a resulting short life of the completed well. It has been reported that sour gas wells have been in operation in Canada using the customary tubular materials since the 1950's. However, other wells driven both on shore and off shore in North America as well as in France, Germany and Austria have encountered high corrosion rates and early failures. The normal tubular materials employed in gas wells are steels of relatively high strength. For example, a steel having a yield strength of 200,000 lbs per square inch is a standard oil field tubular. However, the severity of the problems encountered are such in relation to the wells of even the so-called "intermediate" depths e.g., roughly on the order of 15,000 feet, that consideration must be given to the use of more expensive metallic materials having substantially greater corrosion resistance than the standard high strength steel materials. Of course, to the extent that inhibition techniques can be developed to protect the standard materials for a useful lifetime in the well, such materials will continue to be used. However, in relation to wells wherein temperatures on the order of up to 500° F. and bottom hole pressures on the order of up to possibly 20,000 lbs per square inch are found together with a low pH in the presence of large quantities of hydrogen sulfide together with carbon dioxide and salt, consideration must be given to the use of tubular materials having improved corrosion resistance as compared to the standard high strength steels. Metallurgists in the past have developed an entire array of metallic materials which have been designed for a variety of uses. It would appear to be a relatively easy task to simply reach into the assortment of available materials and extract one which would do the job in relation to the sour wells. Experience has indicated that such is not the case. Thus, a number of alloys are available and in fact have been in wide use in the chemical industry for years, which have a resistance to a wide variety of aggressive media. When fabricated into chemical equipment, such alloys are normally supplied in the annealed condition and have relatively low strength, for example, a room temperature 0.2% yield strength on the order of 45–50,000 lbs per square inch. Strengths of such an order are regarded as being inadequate for use in an oil well tubular wherein much higher strengths have been the rule. It is known that the strengths of such materials can be increased by cold work. It is found, however, that by the time the alloys have been cold worked sufficiently to raise the 0.2% offset yield strength at room temperature to a value on the order of 110,000 lbs per square inch that the elongation (a common indicia of ductility) has been reduced to undesirably low values e.g. less than about 10%. Ductility as indicated by an elongation on the order of 8% is viewed with suspicion on the part of the equipment designers. Thus, the expectation would be that equipment fabricated from such a cold worked material would be subject to unexpected and possibly catastrophic failure. Such alloys are described in U.S. Pat. No. 2,777,766 as containing about 18% to about 25% chromium, 35% to 50% nickel, 2% to 12% molybdenum, 0.1% to 5% of tantalum or columbium or both, up to 5% tungsten, up to 2.5% copper, the remainder iron and incidental impurities. The patent states that carbon is unavoidably present but should not exceed 0.25% and is preferably kept as low as possible, for example, less than 0.1%. The resistance of alloys as described in the patent to corrosive media such as boiling nitric acid, boiling sulfuric acid, aerated hydrochloric acid and a mixture of ferric chloride and sodium chloride is demonstrated by data. However, no physical properties are given in the patent. It is pointed out that the alloys are subject to partial decomposition if exposed to temperatures between 500° C. and 900° C. and annealing at 1100° C. to 1150° C. following by cooling relatively rapidly is recommended. A commercial alloy, Alloy G, which contains 21 to 23.5% chromium, 5.5 to 7.5% molybdenum, 18 to 21% iron, 1 to 2% manganese, up to 0.05% carbon, 1.5 to 2.5% copper, 1.75 to 2.5% columbium plus tantalum, up to 1% silicon and the balance nickel and incidental impurities, is made under this patent. Manufacturers' literature describing Alloy G states that at room temperature 0.125 inch sheet has a yield strength at 0.2% offset of 46,200 lbs per square inch whereas plate in a $\frac{3}{8}$ inch to a $\frac{5}{8}$ inch thickness range had a yield strength of 45,000 lbs per square inch with excellent ductility, for example, as represented by an elongation of 61% or 62%. The manufacturers' literature also indicates that Alloy G may be aged at temperatures such as 1400° F. and 1500° F. A hardness of Rockwell "C" 30 is reported after 100 hours aging at 1500° F. However, the data provided indicate that when the alloy is aged for such long periods of time at temperatures of 1400° F. and 1500° F. that the charpy V-notch impact strength is reduced to low levels. A low charpy impact strength of five foot-pounds is reported after 100 hours at 1500° F. Again the undesirability to a designer of such low impact value is apparent and in fact the manufacturer's literature points out that Alloy G is normally supplied in the solution heat treated condition. Another alloy for a similar service is Alloy 825, which contains 38 to 46% nickel, 0.05% max. carbon, 22% min. iron, 1.5 to 3% copper, 19.5 to 23.5% chromium, 0.2% max. aluminum, 0.6 to 1.2% titanium, 1% max. manganese, 0.5% max. silicon and 2.5% to 3.5% molybdenum. This alloy is also supplied in the mill annealed condition and the manufacturer's brochure lists yield strength at 0.2% offset in the neighborhood of 35,000 lbs per square inch, with an elongation of 30%.

The manufacturer's brochure gives no indication of potential age hardening in respect of the alloy.

SUMMARY OF THE INVENTION

It has now been discovered that through controlled introduction of the age hardening elements, aluminum and titanium, into a nickel, iron, chromium, molybdenum, copper alloy yield strengths on the order of 100,000 lbs per square inch to a 140,000 lbs per square inch, can be provided together with high corrosion resistance. Through combinations of cold work and heat treatment the aforementioned strengths can be provided together with substantial ductility as represented by elongation of 20% at a yield strength level of 100 to 110,000 lbs per square inch. The alloy is workable and is readily provided in the form of seamless tubing.

DETAILED DESCRIPTION OF THE INVENTION

In accordance with the invention, alloys are provided which contain about 38% to about 46% nickel, and about 19.5% to 23.5% chromium, up to about 1.5% aluminum, about 1% to about 3% titanium with the aluminum plus titanium content being at least about 1.3% but not exceeding about 3.25%, about 2.5% to about 3.5% molybdenum, about 1.5% to about 3% copper up to about 3% or 3.5% columbium, e.g., about 1.5% to 3% columbium, and the balance essentially iron. When columbium is present in amounts of about 1.5% or more, aluminum plus titanium may be as low as 1%. The alloy may contain up to 1% manganese, up to 0.5% silicon, up to 2% cobalt, and impurity amounts of sulfur and phosphorus. It will be appreciated that columbum usually is accompanied by a small amount of tantalum. The alloy is age hardenable after treatments at temperatures in the range of about 1150° F. to about 1350° F. for a period of time up to about 24 hours. Other heat treatments include a heating at one temperature within the aforementioned range, a slow cool from the said temperature to a lower temperature with an additional heating time at a lower temperature. For example, a heat treatment comprising heating for 8 hours at 1350° F., a furnace cool to about at 1150° F. with a hold for 8 hours 1150° F. then air cooling to room temperature is effective in treating alloys of the invention. With appropriate combinations of composition, cold work and aging, satisfactory properties are obtainable in relatively short periods of time, e.g., 1 hour. Such heat treatments for short times permit aging of tubes produced in accordance with the invention in a rocker hearth or other type of furnace on a continuous basis. The capability of age hardening the alloy provides substantially improved ductility at a given strength level, e.g., a yield strength (0.2%) offset in the range of about 100,000 to about 140,000 psi or even higher than is the case when an alloy of the same composition is merely cold worked to the same strength level. For example, an elongation of 20% at a yield strength of 146,000 lbs per square inch can be obtained in age hardened alloys provided in accordance with the invention. Even at a yield strength as high as 186,000 lbs per square inch, a tensile elongation of 12.5% has been developed. Desirably, for optimum strength and ductility combinations, the titanium content of the alloys is maintained in the range of about 1.5% to about 2.25% or about 2.5% with aluminum contents of about 0.1% to about 0.6%. Preferably, aluminum plus titanium does not exceed about 3%. When columbium is present, simultaneous presence of high columbium and titanium should be avoided as hot malliability may suffer. It is found that aluminum at a level of about 0.3% is beneficial in melting in order to provide improved and consistent recovery of titanium. The nickel-chromium-molybdenum-copper-iron alloy contemplated in accordance with the invention has excellent corrosion resistance in many media and the corrosion resistance is not detrimentally affected by the age hardening reactions contemplated in accordance with the invention. For example, in the Huey test, which is commonly employed to measure resistance to integranular attack, the alloy of the invention provided essentially the same resistance as a similar alloy which was not age hardenable.

In order to demonstrate the results achievable in accordance with the invention, eight vacuum melts each weighing 14 kilograms were made. The compositions of the 8 melts produced are set forth in the following Table I. The ingots produced were homogenized at 2100° F. for 16 hours, air cooled and thereafter were forged to 13/16" square bars using ¼" drafts at a heating temperature of 2000° F. The squares were hot rolled at 2050° F. to 9/16" diameter hot rolled bars, using reheating as necessary. No difficulties in hot working developed. The resulting bars were annealed at 1725° F. for 1 hour and air cooled. They were then sized by cold swaging to 0.55 inches diameter and reannealed at 1725° F. for 1 hour followed by air cooling. Portions of the bars were cold drawn 17% to ½ inch diameter. Hardness and tensile properties were obtained on the resulting bars in the hot rolled and aged condition and in the cold worked and aged condition with the results set forth in the following Tables.

TABLE I

| | Chemical Analyses | | | | | | | | | | | | |
|---|---|---|---|---|---|---|---|---|---|---|---|---|---|
| Alloy No. | C | Mn | Fe | S | Si | Cu | Ni | Cr | Mo | Al | Ti | B | Al + Ti |
| A | .0051 | .58 | 28.30 | .003 | .14 | 1.59 | 43.31 | 22.34 | 2.93 | .073 | .81 | .003 | .883 |
| 1 | .0045 | .58 | 28.52 | .003 | .14 | 1.58 | 42.50 | 22.45 | 3.03 | .095 | 1.26 | .003 | 1.355 |
| 2 | .009 | .58 | 27.43 | .003 | .13 | 1.63 | 42.70 | 22.33 | 3.04 | .100 | 1.64 | .003 | 1.740 |
| 3 | .009 | .58 | 27.43 | .003 | .14 | 1.62 | 42.40 | 22.47 | 3.03 | .100 | 2.32 | .003 | 2.420 |
| 4 | .015 | .58 | 28.43 | .004 | .14 | 1.65 | 42.46 | 22.48 | 3.02 | .590 | .93 | .003 | 1.52 |
| 5 | .013 | .58 | 27.93 | .004 | .13 | 1.51 | 42.49 | 22.48 | 3.01 | .590 | 1.47 | .003 | 2.06 |
| 6 | .015 | .58 | 27.62 | .003 | .13 | 1.52 | 42.39 | 22.47 | 3.02 | .620 | 1.90 | .003 | 2.52 |
| 7 | .009 | .58 | 27.39 | .003 | .15 | 1.59 | 41.47 | 22.87 | 3.06 | .650 | 2.43 | .003 | 3.08 |

TABLE II

| | Hot Rolled 0.562 Diameter Bar Annealed 1725° F./0.5 HR, AC Rockwell Hardness | | | | | | | |
|---|---|---|---|---|---|---|---|---|
| | Alloy No. | | | | | | | |
| Heat Treatment | A | 1 | 2 | 3 | 4 | 5 | 6 | 7 |
| None | 83b | 82b | 82b | 88b | 83b | 84b | 88b | 26c |
| 1300/1, A | 82b | 96b | 98b | 25c | 96.5b | 97b | 100b | 33c |

TABLE II-continued

| Heat Treatment | A | 1 | 2 | 3 | 4 | 5 | 6 | 7 |
|---|---|---|---|---|---|---|---|---|
| | Hot Rolled 0.562 Diameter Bar Annealed 1725° F./0.5 HR, AC Rockwell Hardness | | | | | | | |
| | Alloy No. | | | | | | | |
| 1300/8, A | 82b | 24c | 100b | 29c | 100b | 99b | 27c | 33c |

TABLE III

| A | 1 | 2 | 3 | 4 | 5 | 6 | 7 |
|---|---|---|---|---|---|---|---|
| .500 ϕ Cold Drawn - As Drawn (17.5% CR) Rockwell Hardness - "C" scale | | | | | | | |
| Alloy No. | | | | | | | |
| 20 | 23 | 23 | 25 | 24 | 22* | 22* | 39 |

*10 Rc at center.

TABLE IV

| Heat Treatment | A | 1 | 2 | 3 | 4 | 5 | 6 | 7 |
|---|---|---|---|---|---|---|---|---|
| | RTT Hot Rolled 0.562" Diameter Bar Condition: 1725° F./0.5 Hr., AC | | | | | | | |
| | Alloy No. | | | | | | | |
| | 0.2% Y.S. (ksi) | | | | | | | |
| None | 42.4 | 43.3 | 43.7 | 53.7 | 44.4 | 46.3 | 48.8 | 86.5 |
| 1300/1, A | 42.4 | 70.8 | 72.4 | 99.2 | 72.8 | 76.7 | 76.0 | 111.5 |
| 1300/8, A | 42.4 | 88.1 | 86.5 | 108.5 | 80.1 | 72.5 | 88.3 | 118.5 |
| | T.S. (ksi) | | | | | | | |
| None | 99. | 102. | 95.7 | 104. | 94. | 98.1 | 112.0 | 147.5 |
| 1300/1, A | 98.8 | 126. | 131.4 | 147.5 | 123. | 133.5 | 147.5 | 162.0 |
| 1300/8, A | 98.7 | 140. | 143. | 158.5 | 128.3 | 143. | 157.5 | 175. |
| | El-RA (%) | | | | | | | |
| None | 44–65 | 46–64 | 50–66 | 49–59 | 48–65 | 49–61 | 50–60 | 31–29 |
| 1300/1, A | 46–69 | 34–59 | 39–56 | 33–44 | 37–51 | 39–53 | 37–58 | 19–14 |
| 1300/8, A | 45–63 | 31–55 | 33–51 | 29–36 | 33–48 | 35–49 | 31–50 | 18–17 |

TABLE V

| Heat Treatment | | As Drawn | 1225° F. 8 Hr. | 1225° F. 16 Hr. | 1275° F. 8 Hr. | 1275° F. 16 Hr. | 1325° F. 8 Hr. | 1325° F. 16 hr. | 1350° F. 8 Hr. |
|---|---|---|---|---|---|---|---|---|---|
| | | Round, Cold Drawn, As Drawn (17% CR) 0.500" ϕ Hardness-Survey Rockwell "C" | | | | | | | |
| Alloy A | AC | 20.5 | 14. | 14. | 16. | 15. | 13. | 13. | — |
| | FC | | 15. | 14. | 14.5 | 15. | 13. | 13. | 12 |
| Alloy 1 | AC | 23. | 32. | 32. | 29. | 31. | 28.5 | 30.5 | — |
| | FC | | 30.5 | 30 | 31 | 33.5 | 31. | 30. | 31 |
| Alloy 2 | AC | 23. | 32.5 | 35 | 32.5 | 36. | 34. | 34. | — |
| | FC | | 33. | 35. | 35. | 35. | 33. | 36. | 36 |
| Alloy 3 | AC | 25. | 36. | 39. | 36. | 40. | 39. | 39. | — |
| | FC | | 38.5 | 40 | 39. | 38. | 38.5 | 39.5 | 40 |
| Alloy 4 | AC | 24. | 29.5 | 29. | 26. | 32. | 30. | 29. | — |
| | FC | | 31.5 | 29.5 | 31.5 | 28.5 | 30. | 32. | 32 |
| Alloy 5 | AC | 22. | 31. | 32. | 31. | 35. | 31. | 33. | — |
| | FC | | 31.5 | 35. | 33.5 | 34.5 | 36. | 35.5 | 34 |
| Alloy 6 | AC | 22. | 33. | 34. | 34. | 37. | 37.5 | 37.5 | — |
| | FC | | 33.5 | 35. | 36. | 34.5 | 38. | 37.5 | 39 |
| Alloy 7 | AC | 39. | 41. | 43. | 42.5 | 43. | 42. | 44. | — |
| | FC | | 44. | 42. | 42.5 | 43. | 44. | 44. | 44 |

AC - Air Cool
FC - Furnace Cool 100/Hr. to 1150° F./8 Hr., A.C.

TABLE VI

| Alloy No. | Condition | 0.2% Y.S. ksi | T.S. ksi | El % | RA % | Hard R "C" |
|---|---|---|---|---|---|---|
| | RTT Properties Cold Drawn Bar 0.500" Diameter Condition: As Drawn (17% Cold Reduction) Age: As Drawn + 1350/8 FC 100/Hr. to 1150/8, AC | | | | | |
| A | As Drawn | 101.0 | 115.0 | 23.5 | 66.5 | 96. "B"* |

TABLE VI-continued

| Alloy No. | Condition | 0.2% Y.S. ksi | T.S. ksi | El % | RA % | Hard R "C" |
|---|---|---|---|---|---|---|
| | RTT Properties Cold Drawn Bar 0.500" Diameter Condition: As Drawn (17% Cold Reduction) Age: As Drawn + 1350/8 FC 100/Hr. to 1150/8, AC | | | | | |
| | As Drawn + Aged | 73.7 | 107.5 | 32. | 64.5 | 12. |
| 1 | As Drawn | 108.5 | 123.5 | 23.5 | 62.5 | 23. |
| | As Drawn + Aged | 113.5 | 151.5 | 22. | 51.5 | 31. |
| 2 | As Drawn | 108.5 | 123.5 | 26.5 | 65.5 | 22. |
| | As Drawn + Aged | 145.5 | 172.0 | 20.5 | 43. | 36. |
| 3 | As Drawn | 109.0 | 128.5 | 28. | 57. | 25. |
| | As Drawn + Aged | 162.0 | 188.0 | 18. | 29.5 | 40. |
| 4 | As Drawn | 107.0 | 123.5 | 25. | 63. | 23. |
| | As Drawn + Aged | 123.0 | 155.0 | 20.5 | 49.5 | 32. |
| 5 | As Drawn | 99.5 | 118.0 | 30.5 | 65.5 | 100. "B"* |
| | As Drawn + Aged | 135. | 170. | 20.5 | 43.5 | 34. |
| 6 | As Drawn | 95.3 | 120.0 | 32. | 62.5 | 100. "B"* |
| | As Drawn + Aged | 146.0 | 181.5 | 20.5 | 41. | 39. |
| 7 | As Drawn | 178.0 | 190.5 | 12.5 | 44. | 40. |
| | As Drawn | | | | | |

TABLE VI-continued

RTT Properties
Cold Drawn Bar 0.500" Diameter
Condition: As Drawn (17% Cold Reduction)
Age: As Drawn + 1350/8 FC 100/Hr. to 1150/8, AC

| Alloy No. | Condition | 0.2% Y.S. ksi | T.S. ksi | El % | RA % | Hard R "C" |
|---|---|---|---|---|---|---|
| | + Aged | 186.5 | 212.0 | 12.5 | 21. | 44. |

"B"* = Rockwell "B" scale

TABLE VII

| Alloy No. | Aging Temp - °F. | Impact ft/lbs | 0.2% Y.S. ksi | T.S. ksi | El % | RA % | Rockwell Hardness |
|---|---|---|---|---|---|---|---|
| A | 1350 | 49 | 77 | 106 | 32 | 67 | 93B |
| 1 | 1300 | 43 | 95 | 126 | 28 | 61.5 | 95-100B |
| 2 | 1350 | 30 | 131.5 | 156.5 | 26 | 56.5 | 34C |
| 3 | 1400 | 22.5 | 155 | 177 | 22 | 45 | 38C |
| 4 | 1300 | 34.5 | 123 | 143.5 | 24 | 52.5 | 30.5C |
| 5 | 1300 | 32.5 | 125 | 150.5 | 30 | 56.5 | 36.5C |
| 6 | 1350 | 28 | 129 | 156.5 | 28 | 53.5 | 36C |
| 7 | 1350 | 6 | 178 | 196.5 | 16 | 35.5 | 43C |

The alloys of Table I in the cold drawn bar condition (17% cold reduction) were heat treated for one hour at the temperature shown in Table VII. Charpy V-notch impact values on one-half size specimens, tensile properties and hardness were obtained as shown in Table VII. Charpy V-notch impact values on standard specimens can be approximated by doubling the values shown in the Table.

The data demonstrate that Alloy A, with low hardener content, showed little or no response to aging heat treatments. The optimum strength and ductility combinations occur between about 1.5% and 2.5% titanium. Aluminum in the amounts investigated had little effect at this titanium level.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. As a new article of manufacture, an oil well tube having a yield strength at room temperature of at least about 110,000 psi, an elongation of at least 10%, together with resistance to environments containing hydrogen sulfide, chloride and water, as well as gaseous and/or liquid hydrocarbons made of an age hardened alloy consisting essentially of about 38% to 46% nickel, about 19.5% to 23.5% chromium, about 2.5% to about 3.5% molybdenum, about 1.5% to 3% copper, about 1% to about 2.5% titanium, about 0.1% to about 0.6% aluminum, the contents of aluminum and titanium being at least 1.3% and up to 3%, up to about 3.5% columbium, not more than 0.15% carbon and the balance essentially iron.

2. A new article of manufacture in accordance with claim 1, wherein said alloy is age hardened to 130,000 psi and has an elongation of about 20%.

3. A wrought alloy consisting essentially of about 38% to about 46% nickel, about 19.5% to about 23.5% chromium, about 2.5% to about 3.5% molybdenum, about 1.5% to about 3% copper, up to about 3.5% columbium, about 1% to about 2.5% titanium, about 0.05% to about 0.6% aluminum, the contents of aluminum and titanium being at least about 1.3%, when columbium content is less than about 1.5%, but not exceeding about 3% not more than about 0.1% carbon and the balance essentially iron.

4. An alloy in accordance with claim 3 wherein the titanium content is about 1.5% to about 25%.

5. An alloy in accordance with claim 4 wherein the columbium content is about 1.5% to about 3%.

* * * * *

UNITED STATES PATENT AND TRADEMARK OFFICE

CERTIFICATE OF CORRECTION

PATENT NO. : 4,358,511

DATED : November 9, 1982

INVENTOR(S) : Darrell F. Smith, Jr. and Edward F. Clatworthy

It is certified that error appears in the above-identified patent and that said Letters Patent is hereby corrected as shown below:

Column 8, line 37, "25%" should read -- 2.25% --.

Signed and Sealed this

*Thirteenth* Day of *March 1984*

[SEAL]

*Attest:*

GERALD J. MOSSINGHOFF

*Attesting Officer*

*Commissioner of Patents and Trademarks*